United States Patent [19]

Schreffler

[11] 3,940,200

[45] Feb. 24, 1976

[54] ELECTRICAL CONDUCTOR ARRANGEMENT INCLUDING FLEXIBLE RACE CONSTRUCTION

[76] Inventor: Robert Z. Schreffler, 12817 Richmond St., Chester, Va. 23831

[22] Filed: Mar. 4, 1975

[21] Appl. No.: 555,277

[52] U.S. Cl. ..... 339/8 PB; 339/5 R

[51] Int. Cl.[2] ..... H01R 39/00

[58] Field of Search ..... 339/5 R, 5 M, 5 P, 5 S, 339/6 RL, 8 PB

[56] References Cited

UNITED STATES PATENTS

| | | | |
|---|---|---|---|
| 1,821,132 | 9/1931 | Baker | 339/8 PB |
| 2,181,145 | 11/1939 | Mose | 339/8 PB |

*Primary Examiner*—Roy Lake
*Assistant Examiner*—DeWalden W. Jones
*Attorney, Agent, or Firm*—Larson, Taylor and Hinds

[57] ABSTRACT

An electrical conductor bearing arrangement for conducting electrical current between rotating and non-rotating members includes at least one flexible annular race which cooperates intermediate ball bearings and a further race to provide the required electrical connection. The flexible race, which is preferably constructed of spring metal or the like, is adapted to be mounted in a support such that the outer circumferential edges of the race are firmly supported while the central recessed portion located between these circumferential edges is unsupported so that the race is free to flex as the bearings ride on the central portion. The support preferably comprises an annular member, which can be constructed of plastic or another insulating material, including spaced support surfaces which extend around the inner and outer circumferential edges and define a circumferential recess therebetween, the depth of the recess in the support member being greater than that of the recessed central portion so that the latter is unsupported.

8 Claims, 4 Drawing Figures

ELECTRICAL CONDUCTOR ARRANGEMENT INCLUDING FLEXIBLE RACE CONSTRUCTION

FIELD OF THE INVENTION

The present invention relates to conductor arrangements for providing an electrical path between rotating and non-rotating members.

BACKGROUND OF THE INVENTION

In my earlier filed application, Ser. No. 850,055, filed on Aug. 14, 1969 and now abandoned, a number of techniques were discussed for maintaining good electrical contact between the non-rotating and rotating race members of an electrical conductor bearing arrangement. Conductor bearing arrangements of this general type characteristically comprise a fixed or non-rotating annular race member, a rotating annular race member adapted to be affixed to a rotating shaft, and a plurality of ball or roller bearings which ride in races defined by the race members. Examples of electrical conductor bearing arrangements of this general type are disclosed in my earlier U.S. Pat. No. 3,501,204.

A very important consideration in constructing conductor arrangements of the type in question is that of providing a constant contact area between the rotating and non-rotating race members which is precisely and continuously maintained. Prior art conductor arrangements generally provide somewhat irregular contact between the fixed and rotating races because of imbalances in the mountings for the races, the geometrical relations between the races and the contact elements whereby different or variable areas of contacts are provided, and the differential expansion of the various parts forming the conductor arrangement.

A further very important consideration is manufacturing cost of the conductor arrangement. Thus, to be economically feasible to manufacture, such an arrangement should be relatively simple in construction yet rugged and efficient, and the individual parts should be relatively inexpensive to make.

SUMMARY OF THE INVENTION

In accordance with the invention, an electrical conductor arrangement is provided for conducting electrical current between rotating and non-rotating members, which arrangement affords improved electrical contact between the fixed and rotating members. More specifically, the arrangement includes a race means on which the bearing members of the conductor arrangement ride comprising a flexible annular race member and an annular support for the race member, the annular support serving to support the inner and outer circumferential edges of the race member while leaving unsupported a central annular portion of the race member between the circumferential edges. This construction of the race means provides conductor arrangement with a flexibility or resiliency which enables continuous, uniform contact to be maintained between the conductive elements, i.e., the races and bearing members. As a benefit of this construction, the effects of any minor irregularities in the elements themselves, due to wear or manufacturing causes, or imbalances in the mountings for these elements, are compensated for, or at least reduced, by the ability of the race or races to flex so as to accomodate such irregularities or imbalances.

A further important advantage of the conductor arrangement of the invention concerns the ease of manufacture thereof. In particular, both the annular race member and the support can be of a very simple design. Moreover, the support can be made of plastic or the like so that the support is extremely easy to manufacture and the cost thereof significantly reduced. It should be noted in this latter regard, that a serious disadvantage of many conductor bearing designs is the amount of copper required in construction of the races. By providing a race construction comprising a thin metal race member and a plastic support or backing, this disadvantage is overcome.

In accordance with a preferred embodiment, the race member includes a recessed central portion in which the bearing members ride and the support member includes an annular groove in which the recessed portion of the race member is received, the depth of the groove being greater than that of the recessed portion so that the latter is unsupported and the race member is supported only at the inner and outer circumferential edges.

Other features and advantages of the invention will be set forth, or apparent from, the detailed description of a preferred embodiment found hereinbelow.

DESCRIPTION OF THE PREFERRED EMBODIMENTS

Figure 1:
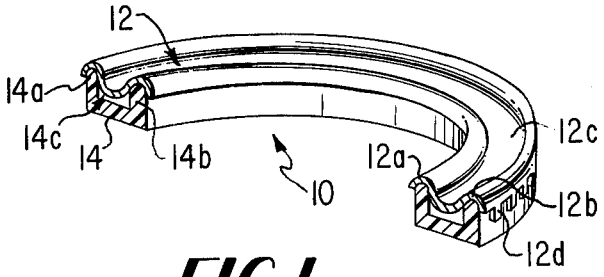
FIG. 1 is a perspective view of one half of a race assembly constructed in accordance with a preferred embodiment of the invention.

Referring to FIG. 1, a race construction or assembly is shown which incorporates many of the important features of the invention. The race assembly, which is generally denoted 10, includes flexible annular race member 12 and a support or backing 14.

Race member 12 is constructed of a conductive material, preferably relatively thin spring metal or the like. As illustrated, race member 12 includes inner and outer raised circumferential edges or edge portions 12*a* and 12*b* and a recessed central race 12*c* defined between these edge portions. Race 12*c* is curved in cross section to conform to the shape of the ball bearings of the conductor arrangement (not shown in FIG. 1) which ride thereon. A series of spaced tabs 12*d* which are located along outer edge 12*b* and extend substantially perpendicularly to the plane of race member 12. Tabs 12*d* enable race member 12 to be snap-fit onto support 14 so that a rigid race assembly is provided. It will, of course, be appreciated that other techniques can be used in mounting or otherwise affixing race member 12 to support 14.

Support 14 includes a central annular groove 14*c* in one surface thereof located between inner and outer support surfaces 14*a* and 14*b*. As illustrated, edge portions 12*a* and 12*b* of race member 12 respectively engage support surfaces 14*a* and 14*b* of support 14 and recessed central portion 12*c* is received in groove 14*c*. The distance or depth to which recessed central portion 12*c* extends below edge portions 12*a*, 12*b* is substantially less then the depth of groove 14*c* so that recessed central portion 12*c* is not supported.

Figure 2:
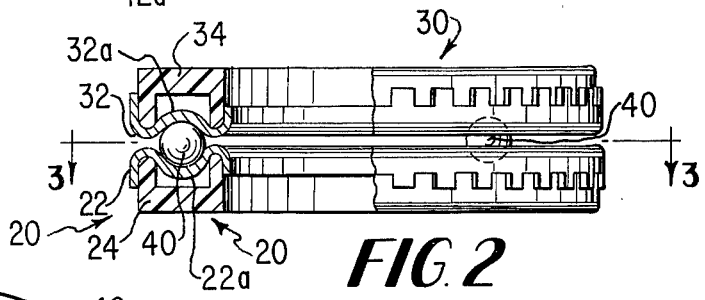
FIG. 2 is side elevational view, partly in section, of a conductor bearing arrangement incorporating two race assemblies corresponding to that of FIG. 1.
Figure 3:
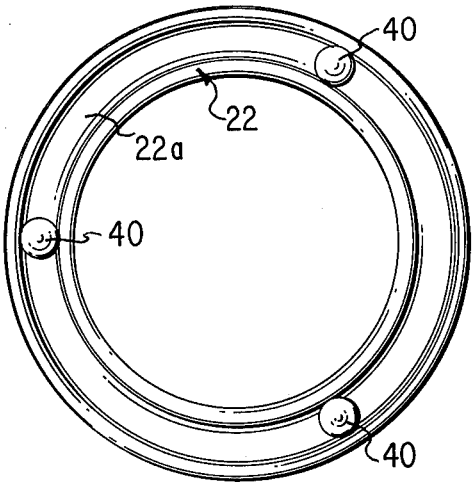
FIG. 3 is sectional view of the arrangement of FIG. 2 taken generally along line III—III of FIG. 2.

Referring to FIGS. 2 and 3, first and second race constructions corresponding to those of FIG. 1 are shown incorporated in an electrical conductor bearing arrangement. The first race member 22 and a support 24 while the second, denoted 30, includes a race member 32 and a support 34. Race members 22 and 32 respectively include curved recessed central portions 22*a* and 32*a* which face each other and which support a plurality of ball bearings 40 therebetween. Although a series of three bearings 40 is shown, it will be appreciated that the number of bearings used is arbitrary, within reason, and that, for example, the number of bearings used can be such as to fill the races, i.e., extend around the entire circumference of the races. It will be appreciated that where less than a full set of bearings is used, an intermediate spacer or the like can be employed between the races to maintain the separation of the bearings. Further, it will be understood that a different form of bearings, such as cylindrical roller bearings, can also be used.

In operation, assuming that race construction 20 is fixed and race construction 30 rotates, bearings 40 provide continuous rolling electrical contact between the two races. As noted hereinabove, the provision of flexible race members 22 and 32 enables the conductor arrangement to absorb or otherwise accomodate imbalances in the mountings for the races, irregularities in the races or bearings due to wear or manufacturing defects and/or other balance or contact problems.

Figure 4:
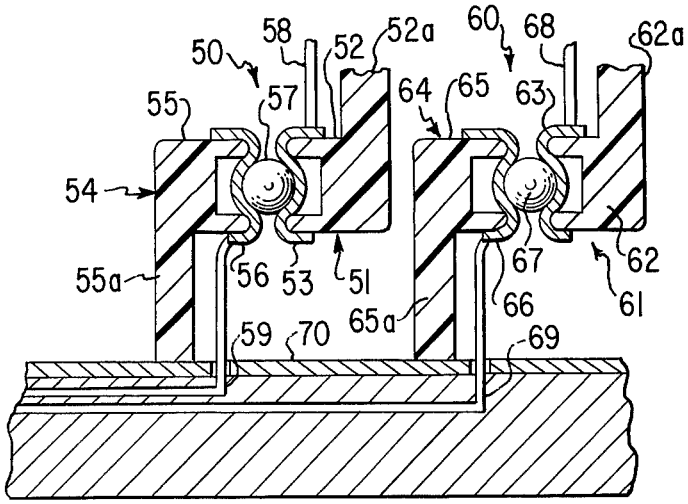
FIG. 4 is a sectional view of a shaft assembly incorporating two conductor arrangements such as those of FIGS. 2 and 3 for conducting electrical current to a device mounted on a shaft.

Referring to FIG. 4, a system for conducting electrical current to a rotating shaft is shown. In this system, two conductor arrangements, corresponding to that of FIGS. 2 and 3, and denoted 50 and 60, are used to conduct current to an electrical device (not shown) mounted on a shaft 70. The conductor arrangement 50 includes a fixed race construction 51 including a support member 52 having a flange 52*a* adapted to be secured to a fixed support, and a race member 53; a rotating race construction 54 including a support member 55 which is affixed by flange 55*a* to shaft 70 and a race member 56; and plurality of ball bearings, one of which, denoted 57, is shown, positioned between race members 53 and 56. Conductor arrangement 60 is of a similar construction. As illustrated, an input lead 58 from a power supply (not shown) is connected to fixed race member 53 while a second lead 59 extends through the shaft wall and connects rotating race member 56 to the electrical utilization device (not shown) mounted on shaft 70. Corresponding leads 68 and 69 connected to conductor arrangement 60, as shown, complete the circuit back to the power supply.

It will be understood that a conductor bearing arrangement incorporating a race construction according to the invention, can be used to mount a rotating conductive connector which would be located between two race assemblies such as have been described. It will also be understood that where, for example, cylindrical roller bearings are used, the supports can comprise concentric rings or annular members which are arranged such that one fits within the other and the two races are mounted on the facing peripheral surfaces, i.e., on the inner peripheral surface of the outer support and the outer peripheral surface of the inner support.

While the invention has been described in detail with particular reference to the preferred embodiments thereof, it will be understood by those skilled in the art that variations and modifications can be effected in the exemplary embodiments within the spirit and scope of the invention.

I claim:

1. An electrical connector arrangement for conducting electrical current between rotating and non-rotating members, said arrangement comprising a first, non-rotating race means, a second, rotating race means spaced from said first race means and adapted to be connected to a rotating shaft, and bearing means located between said race means for providing electrical current conduction between said race means, at least one of said race means comprising an annular flexible race member constructed of an electrically conductive material and a support member for supporting the circumferential edges of said race member while leaving unsupported an annular central portion of said race member located between said circumferential edges, so that said race member makes flexible contact with said bearing means.

2. An electrical connector arrangement as claimed in claim 1, wherein said central portion of said race member is recessed with respect to said circumferential edges so as to provide a race for said bearing means.

3. An electrical connector arrangement as claimed in claim 2, wherein the shape of the recessed central portion of said race member substantially conforms to the shape of the portion of the bearing means received thereby.

4. An electrical connector arrangement as claimed in claim 3, wherein said bearing means comprises a plurality of ball bearings and said recessed central portion of said race member is substantially semi-circular in cross section.

5. An electrical connector arrangement as claimed in claim 2, wherein said support member comprises an annular member including first and second spaced annular support surfaces which respectively extend around the two circumferential edges of said support member and define a recess therebetween, the depth of said recess being greater than the depth of said recessed central portion of said race member so that said recessed central portion is spaced from said recess defining portion of said support member.

6. An electrical connector arrangement as claimed in claim 5 wherein said support member is constructed of a non-conductive material.

7. An electrical connector arrangement as claimed in claim 6, wherein the circumferential edges of said race member each form a concave arc in transverse cross section and receive the reciprocally shaped convex support surfaces of said support member therein.

8. An electrical connector arrangement as claimed in claim 1, further comprising a further non-rotating race means, a further rotating race means spaced from said further non-rotating race means and adapted to be connected to the rotating shaft, and further bearing means located between said further race means for providing electrical current conduction therebetween, said non-rotating race means serving as input and output connections to an electrical device mounted for rotation on said shaft.

* * * * *